United States Patent [19]

Lanier et al.

[11] 4,406,114

[45] Sep. 27, 1983

[54] CORE WIRE COATING STRANDER

[75] Inventors: Jerry W. Lanier; O. Leon Thomas, both of Carrollton, Ga.

[73] Assignee: Southwire Company, Carrollton, Ga.

[21] Appl. No.: 314,897

[22] Filed: Oct. 26, 1981

[51] Int. Cl.[3] ..... D07B 7/12

[52] U.S. Cl. ..... 57/7; 57/295; 57/296

[58] Field of Search ..... 57/7, 8, 295, 296

[56] References Cited

U.S. PATENT DOCUMENTS 3,512,611 5/1970 Hulak ..... 57/296 X 3,646,748 3/1972 Lang ..... 57/7

4,017,579 4/1977 Roe ..... 57/7 X

*Primary Examiner*—Donald Watkins

*Attorney, Agent, or Firm*—Herbert M. Hanegan; Stanley L. Tate; Mike C. Smith

[57] ABSTRACT

Apparatus and method for constructing a corrosion resistant multistrand electrical power cable or wire rope comprising a uniformly greased core wire with at least one outer wire helically applied thereover wherein corrosion inhibitor is and accurately applied to the core wire in a uniform coat immediately prior to stranding of the wires into a cable or rope.

10 Claims, 3 Drawing Figures

FIG. 1
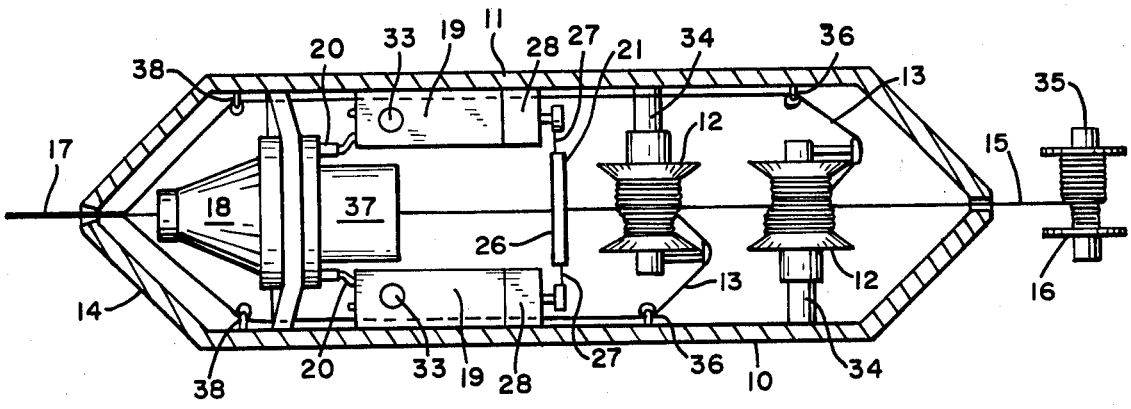
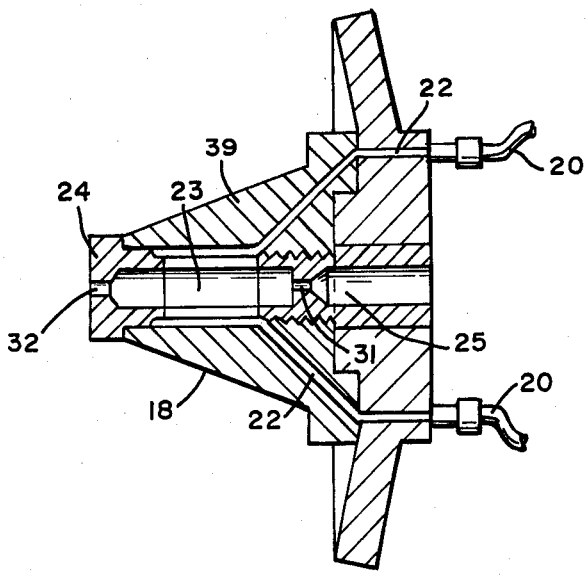
FIG. 2
FIG. 3
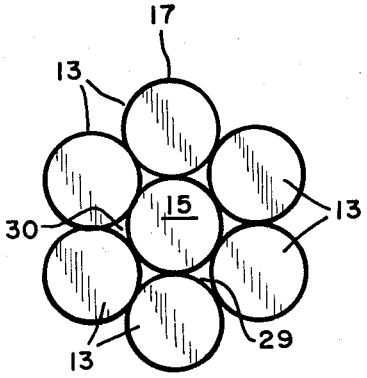

CORE WIRE COATING STRANDER

TECHNICAL FIELD

The present invention relates generally to wire rope and cable mking and specifically to apparatus for and a method of applying corrosion inhibitor such as grease to the surfaces of a core wire as the wire is stranded into an electrical cable or wire rope.

BACKGROUND ART

Electrical cables and wire rope often comprise a plurality of individual strands which may be stranded together by mechanisms such as those disclosed in U.S. Pat. Nos. 3,827,225 and 3,902,307. During wire stranding operations, one or more individual wire strands are helically wrapped over a core wire to form a multistrand cable. The individual strands usually consist of bare wire and it has become common practice in the art to apply some type of protective coating compound onto the cable in order to protect the cable from deterioration. It has been found that without the presence of such a protective coating, moisture and other contaminants accumulate in the numerous interstices existing between the wire strands and such contributes to and accelerates the corrosion of the cable thereby shortening its useful life.

A multistrand cable such as that shown in U.S. Pat. No. 3,647,939 used for transmission of electrical power often has at least one high strength strand to reinforce the cable. Such reinforcement is particularly desirable in overhead conductor applications because of tensional stresses associated therewith. While the reinforcement strand may be an aluminum alloy as disclosed by U.S. Pat. No. 3,647,939, other metals such as ferrous metals are often used. One example is the conventional ACSR (Aluminum Conductor Steel Reinforced) type cable.

Since overhead conductors are routinely exposed to the elements, such as rain, salty coastal atmosphere and other corrosive environments, and since the reinforcement strand may also interact corrosively with the other strands, cable manufacturers normally take special steps to minimize deterioration of the reinforcement strand. Such steps include galvanization of the reinforcement strand and application of a corrosion inhibitor coating to the strand. One method of applying coating to the strand is to submerge an entire roll of strand in grease or some other coating prior to mounting in the strander mechanism. However this method is inefficient, and messy because the coating is not uniformly applied to the strand and such method promotes unpredictable dripping and dispersion of coating material onto other strands, the strander mechanism, and adjacent apparatus.

Another method used in the art is to spray the coating compound onto the strands at a location just upstream of the closing blocks of the strander so that the multistrand cable is coated with compound when it exits from the closing blocks. This technique is disadvantageous in that the compound is not uniformly distributed over the wire strands with the undesirable result that as the cable exits from the closing blocks, it has some portion which are lumped with an excessive amount of compound, other portions which are covered with a very sparse amount of compound, and portions which are not covered at all. Since the compound is applied to the strands by spraying, much of the compound avoids contacting the strands altogether and therefore a recovery system must be used to collect the unused compound and recirculate it back to the spray nozzle. Furthermore, due to the uneven and inconsistent application of the compound, the resultant cable has a poor quality which detrimentally affects its commercial value as well as its possible fields of use.

Other methods include passing all strands through a fluid bath as shown by U.S. Pat. Nos. 3,885,380 and 3,889,455. However these methods also require elaborate compound recovery systems, limitations on stranding speed and productivity, and additional steps such as rewinding.

The state of the prior art is taught by U.S. Pat. No. 3,923,003 wherein flooded multistrand cable is produced by applying a coating of flooding compound onto a bare wire strand and then using the coated strand as a center strand in a stranding operation. The bare wire strand is coated with compound by passing it through a bath of viscous flooding compound and as the coated strand exits from the bath, it is drawn through a restricted opening in a rubber wiper disc. The wiper disc removes excess compound from the coated strand and forms the remainder thereof which adheres to the strand in a uniform coating. The coated strand is then used as the center strand in a stranding operation during which a plurality of bare wire strands are tightly wrapped in a helical fashion about the periphery of the coated center strand to thereby form the multistrand cable. A set of post formers then compress and squeeze the multistrand cable into a symmetrically round cable product and the compressive action is sufficient to extrude and force the compound from the coated center strand outwardly through the interstices existing between the wrapped peripheral strands. The compressive action of the post formers effectively distributes and spreads the flooding compound over the entire surface of each strand to thereby produce a flooded multistrand cable having a round cross section and a uniform coating of flooding compound along its whole length. While this method of coating the wire is very efficient, it normally requires one step for coating the core wire and then a second step for stranding the cable. The steps may be performed in line to produce a continuous coating and stranding process, but since the coated core wire must then travel through the length of the strander, a coating such as grease may become contaminated, lose uniformly, drip from the core wire, and be removed from the core wire by contact with various portions of the strander.

The present invention solves the prior art problems while reducing the process to a single efficient step.

DISCLOSURE OF INVENTION

This invention is an apparatus for efficiently and cleanly applying a uniform coat of grease to a core strand of a multistrand cable. The apparatus is symmetrically mounted on a cable strander to assure balanced rotation of the strander mechanism. The strand chosen for application of grease (normally the reinforcement core strand) passes through apparatus of the present invention wherein a uniform thin layer of grease is applied immediately before the strand is stranded together with one or more other strands to form a multistrand cable. Depending on the type and size of cable, the layer of grease may be thick enough to fill all cavities between the surface of the core strand and the surfaces of the outer strands.

Thus a major object of this invention is to provide an apparatus for applying a uniform layer of grease or some other corrosion inhibitor to a strand of a multistrand cable or wire rope immediately before stranding to prevent contamination and distortion of the coating.

Another object is to provide an apparatus for applying a uniform layer of corrosion inhibitor to a central core wire of a multistrand cable or wire rope.

Another object is to eliminate waste of the corrosion inhibitor by providing means for applying only the amount required.

Yet another object is to more effectively combat corrosion by eliminating areas of inadequate coverage.

Another object is to provide a cleaner method of applying corrosion inhibitor to the strand.

Still another object is to provide a multistrand cable for transmission of electrical power characterized by a core strand having a uniform layer of corrosion inhibitor thereon for optimum corrosion resistance.

BRIEF DESCRIPTION OF DRAWINGS

While the specification concludes with claims particularly pointing out and distinctly claiming the subject matter which is regarded as the invention, it is believed that the invention, objects, features and advantages thereof will be better understood from the following description taken in connection with accompanied drawings in which like parts are given like identification numerals and wherein:

FIG. 1 is a top view of the greasing strander of the present invention;

FIG. 2 is a cross sectional view of the grease applicator of the present invention; and FIG. 3 is an end view of multistrand cable for transmission of electrical power having a uniformly greased core strand.

BEST MODE FOR CARRYING OUT THE INVENTION

The preferred embodiment is illustrated by FIG. 1 where the core wire coating strander is indicated generally at 10. The strander 10 is a high speed mechanism with a rotatable frame 11 and one or more wire carrying bobbins 12 from which outer wire 13 is paid off and advanced to a winding end 14 where the outer wire 13 is helically wrapped over a core wire 15 supplied by spool 16 to form cable 17. Outer wire bobbins 12 are supported by support means 34 and the outer wire 13 is guided by outer wire guide means 36 toward the winding means 38 for winding over the core wire 15. Core wire spool 16 is supported by core wire spool support means 35 and core wire 15 is guided toward winding means 38 by core wire guide 37. The strander 10 operates in the manner taught by U.S. Pat. Nos. 3,827,225 and 3,902,307 which are specifically incorporated herein by reference.

While the strander 10 shown is a specific type of strander known in the art as a tubular strander, the inventive concept disclosed herein may also be used with other stranding mechanisms such as those referred to in the art as circular mill stranders or rigid frame stranders.

This invention provides the ability to cleanly and efficiently apply a uniform layer of corrosion inhibitor to the core wire 15 immediately before the winding end 14. Apparatus mounted on frame 11 (in a symmetrical manner to assure balanced rotation of the strander) comprises an applicator 18, corrosion inhibitor storage means 19, corrosion inhibitor passageways 20, and inhibitor transfer means 21.

As the strander 10 operates, the speed of the strander 10 and the speed of the advancing core wire 15 determine the speed of operation of inhibitor transfer means 21 which forces an appropriate amount of corrosion inhibitor from storage means 19, through passageways 20, to applicator 18.

The applicator 18 is advantageously placed immediately prior to the point where the outer strands 13 helically cover the coated core wire 15 to prevent dripping of inhibitor, smearing of inhibitor (such as on eyelets), contamination by dirt, dust and other contaminants, and premature deformation. Since the applicator 18 is adjacent to the winding end 14, the core wire 15 exiting the applicator 18 is not touched by any apparatus until after the outer strands 13 are applied to form cable 17.

Inhibitor transfer means 21 as shown in FIG. 1 is a planetary drive system which comprises a large central stationary pulley 26, belts 27, and orbit pumps 28. As the strander 10 operates, the frame 11, applicator 18, passageways 20, pressurized storage means 19, and orbit pumps 28, begin to rotate about the longitudinal axis of the core wire 15 path while pulley 26 remains stationary. Belts 27 travel along the periphery of pulley 26 and drive pumps 28 at speeds directly proportional to the speed of the strander 10 which is relative to the speed of the core wire's 15 travel through applicator 18. The pumps 28 are adjustable to compensate for changes in core wire 15 dimensions which require varying quantities of grease. As the strander 10 speed increases, the pumps 28 exert more force to move more inhibitor from storage means 19 through passageways 20 and into applicator 18 to coat the greater surface area of core wire 15 passing therethrough, and when the strander 10 slows or stops, the pumps 28 do likewise. Electrical transfer means and other mechanical transfer means such as centrifugal actuator devices are anticipated.

FIG. 2 shows the applicator 18 in more detail. The symmetrically balanced inhibitor passageways 20, direct the corrosion inhibitor into the applicator housing 39 through two or more inhibitor channels 22 where the inhibitor flows into a central application chamber or cavity 23 which is concentric with the longitudinal axis of the core wire 15 path. Lateral surfaces of the chamber or central cavity 23 are defined by its inscription within the applicator housing 39 while the forward surface is defined by a sizing tip 24 and the rear surface is defined by a sizing insert 25. Tip 24 and insert 25 each have apertures 31 and 32 concentric with the longitudinal axis of the predetermined core wire 15 path, and each aperture is slightly larger than the size of the core wire 15 sufficient to provide for a thin uniform coat of inhibitor without surplus inhibitor exiting the cavity 23 in either direction. The aperture 32 of tip 24 is circular and has a preferred diameter of 1.27639 D where D equals the diameter of the core wire 15. The aperture 31 of the insert 25 is preferably slightly smaller than the aperture 32 of the tip 24 so that insert 25 has a tendency to act as a seal to prevent passage of inhibitor in a direction opposite to the core wire 15 direction of travel. The tip 24 and insert 25 are removable, so that tips 24 and inserts 25 having different aperture dimensions can be used as the core wire 15 size specifications vary. Additionally, the tip 24 and insert 25 are made of a wear resistant material such as medium or high carbon steel.

While it is anticipated that any one of numerous coating materials may be uniformly applied to a core wire 15 by the apparatus of this invention, a corrosion inhibitor is most advantageously applied in this manner. The preferred corrosion inhibitor is a grease and should have the following characteristics: ASTM D-217 measured penetration at 77° F. of from about 270 mm to about 350 mm; smooth texture; barium, aluminum complex, lithium or lithium-calcium ASTM D-218 measure soap content of from about 5% to about 14%; ASTM D-2265 measured dropping point from about 360° F. to about 475° F.; ASTM D-2270 indexed viscosity at 100° F., SUS from about 450 to about 800; from about 1 to about 8 ASTM D-942 measured oxidation stability psi drop per 100 hours; specific gravity of from about 0.890 to about 0.925; and must pass the ANSI/ASTM B 117 salt spray corrosion test. Two such products which have been successfully used are Shell MP Grease 2 distributed by Shell Oil Company and Sunaplex 781 distributed by SUN Petroleum Products Company.

Where it is desired to produce a cable having a core wire flooded with a material such as tar, heating means 33 should be combined with storage means 19 to facilitate flow of the material.

As FIG. 3 illustrates, the final product is a multistrand cable 17 comprised of a core wire 15, a uniform layer of grease thereon, and at least one outer wire 13 helically wrapped over the greased core wire 15. The uniform layer of grease 29 on the periphery of the core wire 15 typically ranges from about 0.007 inches (0.018 mm) to about 0.020 inches (0.051 mm) thick. Where it is intended to cover only the core wire, the grease thickness should be about 0.007 inches (0.018 mm). If the desire is to fill the interstices 30 between the wires 15 and 13, the thickness usually should be about 0.015 inches (0.038 mm). The most desirable thickness to fill the interstices is calculated by the formula $T=0.27639D$ where D is the core wire diameter and T is the desired thickness to fill the interstices. When the cable 17 requires grease on all strands, the grease layer 29 should be about 0.020 inches (0.051 mm) thick to be effectively distributed over the entire surface of each strand by post forming means of the type disclosed in U.S. Pat. No. 3,923,003 or by other means such as a conventional closing block.

This embodiment is, of course, merely exemplary of the possible changes or variations. Because many of the varying and different embodiments may be made within the scope of the inventive concept disclosed herein, and because many modifications may be made in the embodiment herein detailed in accordance with the descriptive requirements of the law, it should be generally understood that the details herein are to be interpreted as illustrative and not in a limiting sense.

INDUSTRIAL APPLICABILITY

This invention is capable of exploitation in the wire rope and cable industries. It is particularly useful in a system for the manufacture of corrosion resistant metallic multistrand cable used for transmission of electrical power and corrosion resistant metallic wire rope.

We claim:

1. A core wire coating strander comprising:

(a) a frame having an upstream end and a downstream end;

(b) means for supporting a core wire spool upstream of said downstream end;

(c) means for supporting one or more outer wire bobbins upstream of said downstream end;

(d) means for guiding core wire from said core wire spool toward said downstream end;

(e) means for guiding outer wire from said outer wire bobbin toward said downstream end;

(f) storage means located upstream of said downstream end for storing coating material;

(g) applicator means located near said downstream end and having a central chamber through which said core wire travels for extruding a discrete layer of said coating material to the surface of said core wire;

(h) transfer means for moving said coating material from said storage means to said applicator means; and (i) winding means located near said downstream end for helically winding said outer wire over said core wire immediately after said discrete layer is applied;

further provided that no apparatus contacts said coated core wire between application of said discrete layer and winding of said outer wire onto said coated core wire thereby avoiding removal, contamination or premature deformation of said discrete layer.

2. A core wire coating strander comprising:

(a) a frame having an upstream end and a downstream end;

(b) means for supporting a core wire spool upstream of said downstream end;

(c) means for supporting one or more outer wire bobbins upstream of said downstream end;

(d) means for guiding core wire from said core wire spool toward said downstream end;

(e) means for guiding outer wire from said outer wire bobbin toward said downstream end;

(f) storage means located upstream of said downstream end for storing coating material;

(g) applicator means located near said downstream end and having a central chamber through which said core wire travels for applying a discrete layer of said coating material to the surface of said core wire, an applicator housing having a central cavity inscribed longitudinally and concentrically therein from front to back, at least two coating material channels symmetrically extending from said central longitudinal cavity to the outer surface of said housing, a wear resistant sizing insert located in the upstream end of said longitudinal cavity and having a central aperture slightly larger than the core wire diameter for receiving the advancing core wire, and a wear resistant sizing tip located in the downstream end of said central cavity and having a central aperture slightly larger than the core wire diameter for discharging the advancing core wire with a discrete, uniform layer of coating material thereon having a thickness of from about 0.007 inches (0.018 mm) to about 0.020 inches (0.051 mm);

(h) transfer means for moving said coating material from said storage means to said applicator means; and (i) winding means located near said downstream end for helically winding said outer wire over said core wire immediately after said discrete layer is applied;

further provided that no apparatus contacts said coated core wire between application of said discrete layer and winding of said outer wire onto said coated core wire thereby avoiding removal, contamination or premature deformation of said discrete layer.

3. The apparatus of claim 2 wherein said sizing tip aperture is circular and has a diameter of about 1.27639D where D equals the diameter of said core wire and said sizing insert aperture is less than 1.27639 D to encourage said sizing insert aperture to act as a seal to the flow of coating material therethrough.

4. The apparatus of claim 2 wherein said applicator means further comprises a central application chamber defined laterally by the periphery of said central cavity, and defined longitudinally by said sizing tip at the downstream end and said sizing insert at the upstream end.

5. The apparatus of claim 2 wherein said storage means further comprises at least two balanced storage containers symmetrically mounted on said frame.

6. The apparatus of claim 2 wherein said transfer means further comprises a planetary drive system comprising:

(a) a stationary central pulley;

(b) at least two orbital pumps symmetrically mounted on said frame and driven by said central pulley; and (c) coating material passageways equal in number to the quantity of orbital pumps and symmetrically mounted on said frame, each extending from a storage means to an orbital pump and then to said applicator means.

7. The apparatus of claim 5 wherein said storage containers further comprise heating means.

8. A method of applying a discrete layer of coating material to the surface of a core wire of a multistrand electric cable or wire rope as the cable or rope is being formed comprising the steps of:

(a) providing a strander having coating material storage means, coating material applicator means, and coating material transfer means;

(b) transferring said coating material from said storage means to said applicator means;

(c) advancing said core wire along a predetermined path through said coating material applicator means;

(d) extruding a uniform discrete layer of coating material onto the surface of said core wire; and (e) then immediately winding one or more outer strands helically over said core wire;

further provided that no apparatus contacts said coated core wire between application of said discrete layer and winding of said outer strands onto said coated core wire thereby avoiding removal, contamination or premature deformation of said discrete layer.

9. The method of claim 8 wherein step (d) further comprises applying a layer of coating having a thickness from about 0.007 inches (0.018 mm) to about 0.020 inches (0.051 mm).

10. The method of claim 8 wherein step (d) further comprises applying a layer of coating having a thickness calculated by the formula $T=0.27639\ D$ where D equals the core wire diameter and T equals thickness.

* * * * *